United States Patent [19]

Ashley

[11] 4,132,149

[45] Jan. 2, 1979

[54] LIQUID PROPELLANT WEAPON SYSTEM

[75] Inventor: Eugene Ashley, Burlington, Vt.

[73] Assignee: General Electric Company, Burlington, Vt.

[21] Appl. No.: 839,227

[22] Filed: Oct. 4, 1977

Related U.S. Application Data

[62] Division of Ser. No. 707,143, Jul. 20, 1976, Pat. No. 4,069,739.

[51] Int. Cl.[2] ..... F41F 1/04; F41F 15/00

[52] U.S. Cl. ..... 89/1.704; 89/1.705; 89/7

[58] Field of Search ..... 89/1.7, 1.703, 1.704, 89/1.705, 1.706, 7, 8; 102/38 LP

[56] References Cited

U.S. PATENT DOCUMENTS

| | | | |
|---|---|---|---|
| 2,924,149 | 2/1960 | Musser | 89/1.703 |
| 2,960,031 | 11/1960 | Clift | 102/38 LP X |
| 3,011,404 | 12/1961 | Russell | 102/38 LP X |
| 3,376,784 | 4/1968 | Abramson | 89/1.703 |
| 3,490,330 | 1/1970 | Walther | 89/1.706 X |
| 3,505,958 | 4/1970 | Vilbago | 89/1.704 X |

*Primary Examiner*—David H. Brown
*Attorney, Agent, or Firm*—Bailin L. Kuch

[57] ABSTRACT

A gun and ammunition system utilizing a round of ammunition which contains a supply of liquid propellant and after ignition pumps this propellant into the combustion chamber of the gun.

1 Claim, 21 Drawing Figures

Fig. 1.
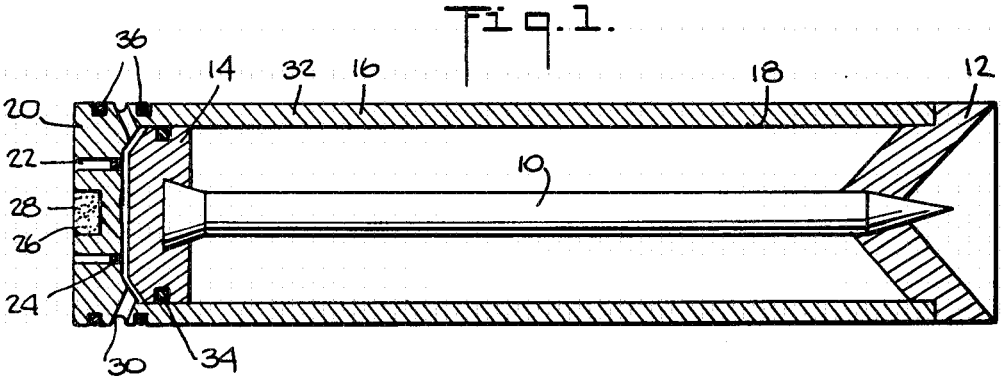
Fig. 3.
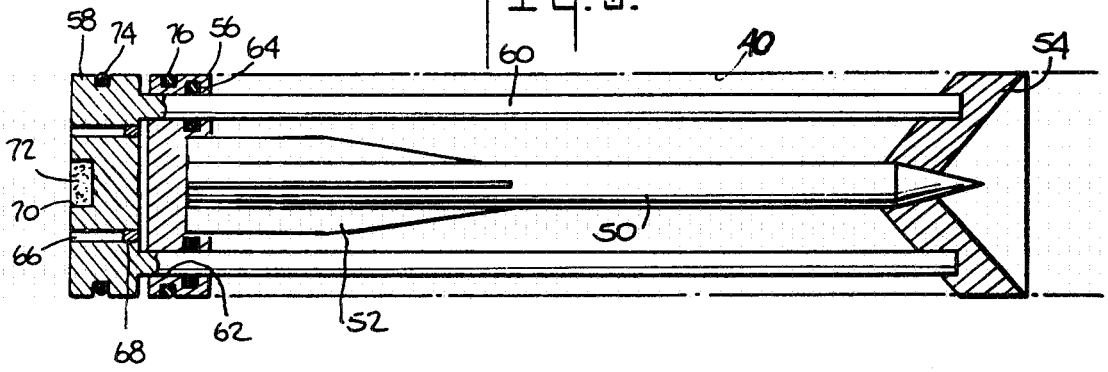
Fig. 4.
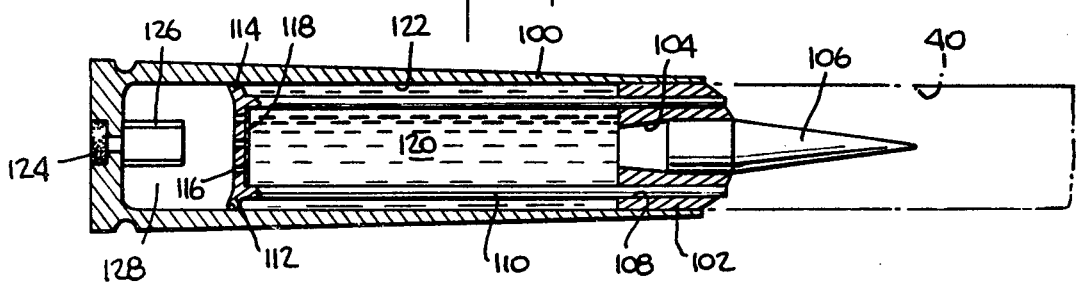
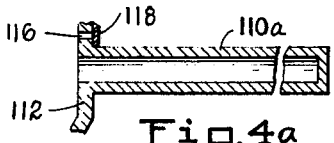
Fig. 4a
Fig. 5.
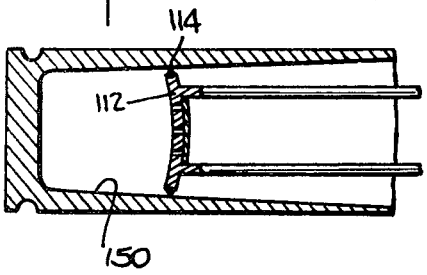
Fig. 6.
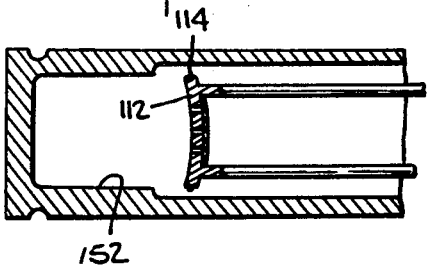

LIQUID PROPELLANT WEAPON SYSTEM

This application is a division of Ser. No. 707,143, filed July 20, 1976, now U.S. Pat. No. 4,069,739.

BACKGROUND OF THE INVENTION

1. Field of the Invention

This invention relates to weapon systems employing a liquid propellant, and particularly to such systems wherein the propellant is continuously pumped into the combustion chamber as the projectile advances along the firing bore.

2. Prior Art

Weapons systems providing traveling charge effects on projectiles, or rockets, or other related systems, are shown, for example, in U.S. Pat. Nos. 3,431,816; 3,411,403; 3,459,101; 3,496,827; 3,601,056; 3,613,499; 3,628,457; 3,648,616; 3,665,803; 3,696,749; 3,698,321; 3,712,171; and 3,728,937. In a final report for the Bureau of Ordnance, Department of the Navy, under Contract NOrd 16217 Task 1, dated Sept. 1, 1957, work was described on a propellant carrying projectile. "This projectile contained approximately 100 grams of a hydrazine, hydrazine nitrate, water monopropellant (63, 32, and 5% by weight respectively). Upon ignition of the primary bipropellant charge in the breech, regenerative injection of the bipropellants progresses in the usual manner, and the projectile is accelerated. The accelerating forces upon the projectile components are so adjusted as to produce relative motion between the projectile body and the center plunger. This motion expels the extrapped monopropellant rearward past the fragile seal disk into the hot combustion chamber gases, where it burns while the projectile is accelerated." The projectile apparently comprised a forward solid cylindrical projectile whose outer wall engaged the inner wall of the firing bore, an intermediate, longitudinally central rod journaled through a bore in the projectile, and an aft sealing disk fixed to the rod and whose periphery engaged the inner wall of the firing bore. The monopropellant was trapped between the forward cylindrical projectile and the aft disk within the firing bore. Solid primary charges were also used in lieu of liquid primary charges. A separate static sealing disk was also used in lieu of the peripheral seal on the aft sealing disk.

SUMMARY OF THE INVENTION

It is an object of this invention to provide a gun and ammunition system for launching rod-shaped projectiles at high velocity.

It is an additional object to provide such a system utilizing liquid propellants.

A feature of this invention is the provision of a gun and ammunition system utilizing a round of ammunition which contains a supply of liquid propellant and after ignition pumps this propellant into the combustion chamber of the gun.

An additional feature of this invention is the provision of a gun and ammunition system utilizing a round of ammunition carrying a relatively narrow diameter and relatively high mass projectile in a relatively wide and relatively low mass sabot, which is initially accelerated by a primary propellant charge in the combustion chamber aft of the projectile and which is subsequently accelerated by a secondary propellant charge in the round which is passed during a relatively extended period of time to the combustion chamber.

BRIEF DESCRIPTION OF THE DRAWING

These and other objects, features and advantages of this invention will be apparent from the following specification thereof taken in conjunction with the accompanying drawing in which:

FIG. 1 is a view in longitudinal cross-section of an idealized round of ammunition having a sabot and a system to regeneratively pump liquid propellant, the round is here shown in its telescoped, minimum length configuration, without liquid propellant;

FIG. 3 is a view in longitudinal cross-section of a second embodiment of this invention;

FIG. 4 is a view in longitudinal cross-section of a third embodiment of this invention;

Figure 8:
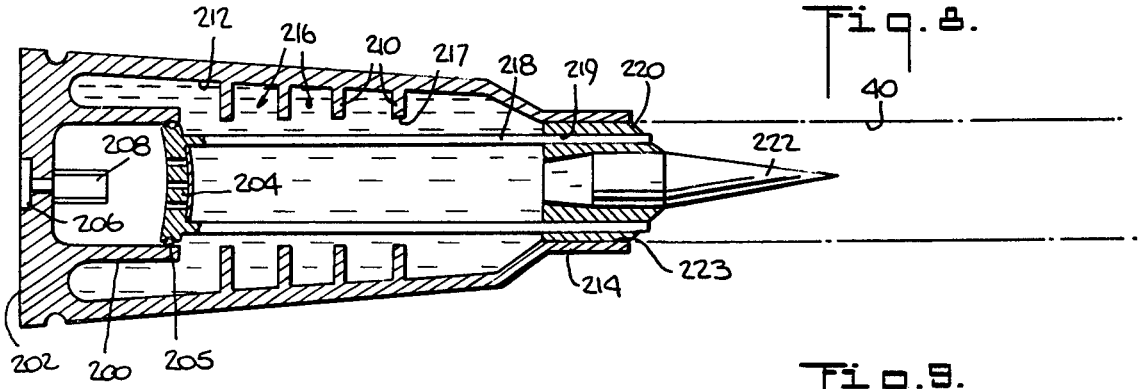
Figure 9:
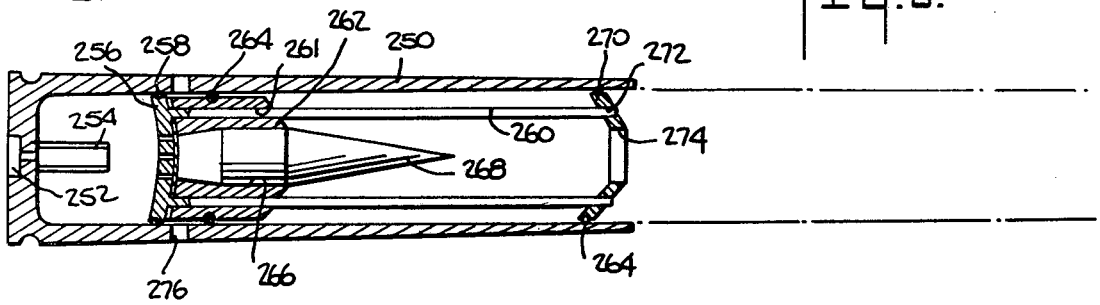
Figure 10:
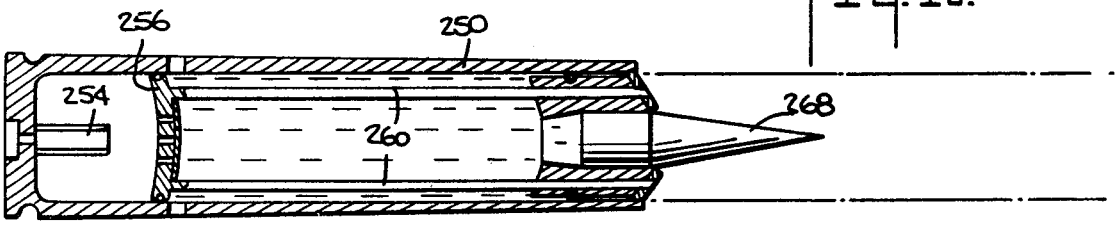
Figure 7:
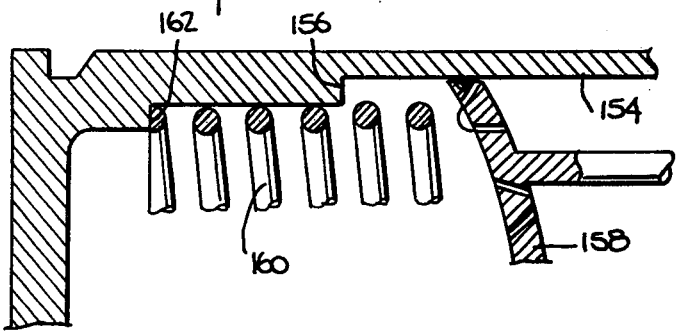
Figure 13:
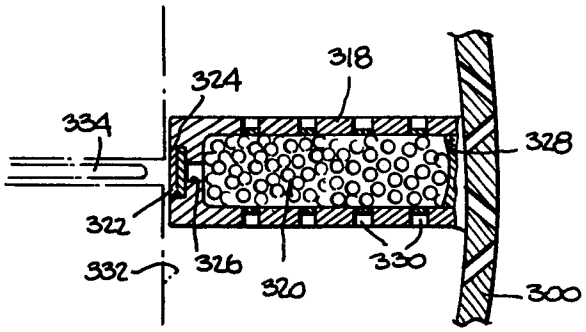
Figure 11:
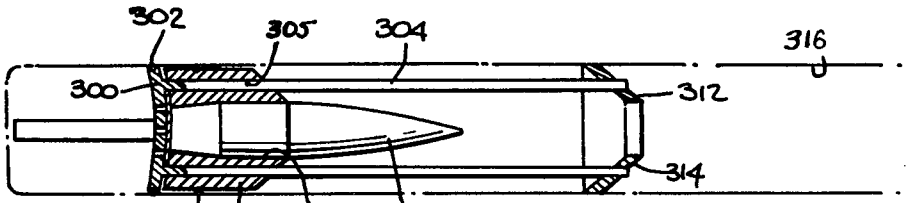
Figure 12:
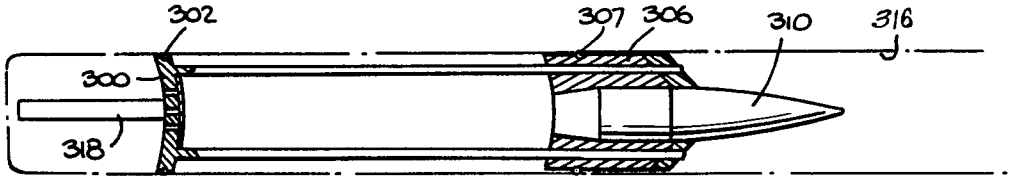
Figure 14:
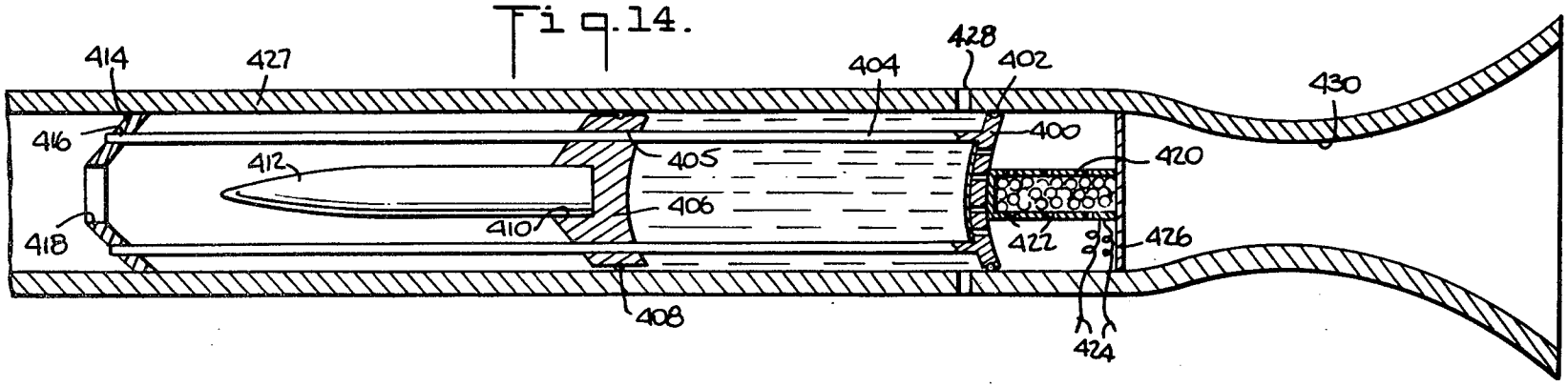
Figure 15:
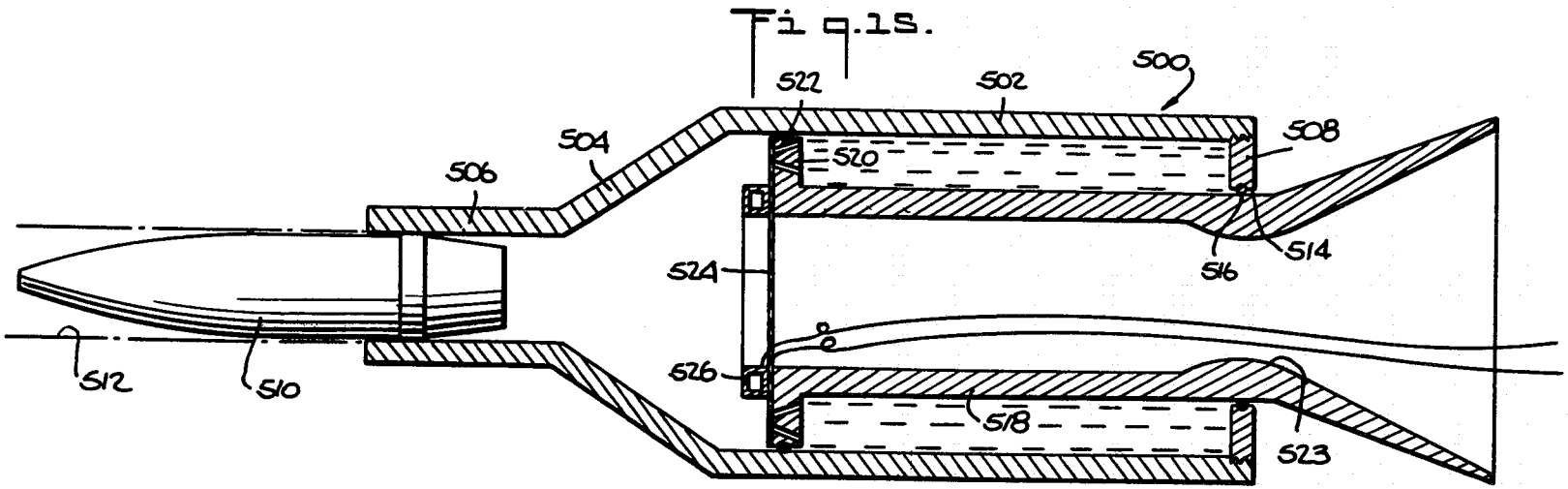
Figure 16:
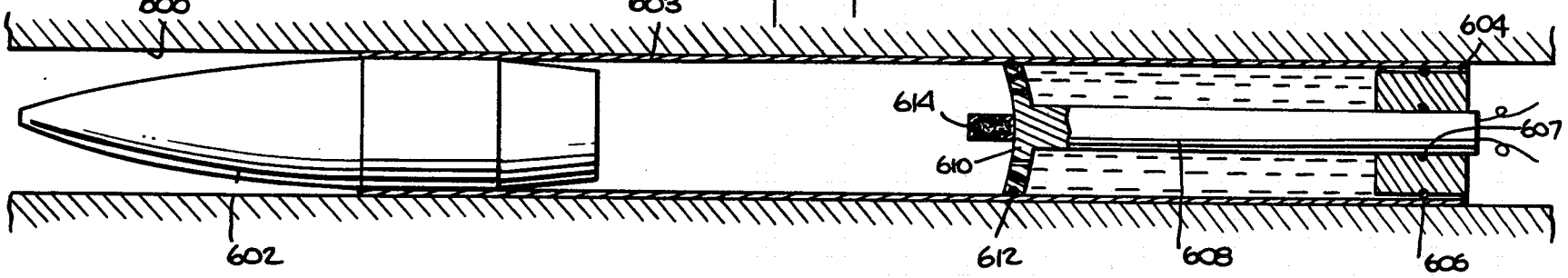

FIG. **4*a* is a detail of a variant of the embodiment shown in FIG. 4**;

FIGS. 5 and 6 are views in longitudinal cross-section of a fourth embodiment of this invention;

FIG. 7 is a view in longitudinal cross-section of a fifth embodiment of this invention;

FIG. 8 is a view in longitudinal cross-section of a sixth embodiment of this invention;

FIGS. 9 and 10 are views in longitudinal cross-section of a seventh embodiment of this invention;

FIGS. 11, 12 and 13 are views in longitudinal cross-section of an eighth embodiment of this invention;

FIG. 14 is a view in longitudinal cross-section of a ninth embodiment of this invention;

FIG. 15 is a view in longitudinal cross-section of a tenth embodiment of this invention; and FIG. 16 is a view in longitudinal cross-section of an eleventh embodiment of this invention.

DESCRIPTION OF THE EMBODIMENTS

Rod shaped penetrators launched at high velocities from medium caliber guns are effective against some types of armor. Since rod penetrators are characteristically long and thin, sabot launching techniques are conventionally employed. The sabot in this case is essentially a light weight piston of diameter larger than the penetrator, and which supports the heavier penetrator. In the launching or firing process, the combustion gas acts against the area of the full diameter of the sabot, rather than against the rod alone, in accelerating the two in combination.

Liquid propellants have several desirable characteristics, such as relatively low flame temperature and ease of storage and handling. A major problem in the use of liquid propellants lies in the control of the ballistic process in the combustion chamber. Propellant can be either placed in the chamber before firing and then be ignited; or it can be metered into the chamber during the combustion process. The last mentioned, sometimes called preloading, is easier to do mechanically, but permits little control over burning after ignition. U.S. Pat No. 3,763,739 issued to D. P. Tassie on Oct. 9, 1973, discloses a gun system of this type. The second mentioned, sometimes called force injection, permits control over the rate of burning through control over the rate of introduction of the propellant, but involves extremely high pumping pressures. Such high pressures pose stringent requirements on seals, fittings and structural components. If the energy for forced injection is to be supplied from an external source, the power requirements are very high. For example, the power required to pump 3 cubic inches of propellant across a pressure drop of 10,000 psi in 20 milli-seconds is 227 hp. This can be averaged over a larger period in an actual gun to lower the peak value, but the power requirement is still unreasonable.

An effective solution to the power requirement for pumped injection is to utilize the combustion chamber pressure itself as the source of energy for pumping. Called regenerative injection, this scheme uses a differential area piston for each propellant. The larger end of the piston is acted on by the chamber pressure, and the smaller end pressurizes the propellant to be injected. The difference in areas generates a propellant pressure sufficiently high than the chamber pressure to achieve the desired rate of injection.

FIRST EMBODIMENT

Turning now to FIG. 1, a first embodiment of the invention is shown as an idealized round of ammunition having a sabot and regenerative, liquid propellant pumping system, for use in a gun which will fill the round with propellant before firing. The penetrator 10 is here shown as a rod which upon launching will be drag stabilized. The sabot is a three piece assembly, comprising an annular nose stabilizer 12 fixed to the forward end of the penetrator, a circular pusher-plate 14 fixed to the aft end of the penetrator, and a cylindrical body 16. The body 16 has an internal bore 18 closed at its aft end 20, which bore receives the plate 14. The aft end 20 serves as an injector plate and has a plurality of longitudinal bores 22 therethrough serving as injection passageways. Each bore is obturated by a respective plug 24. An aft recess 26 receives a primary propellant charge, here shown as a solid primer 28. One or more substantially radially oriented bores 30 pass through the side wall 32 of the body into the interface between the plate 20 and the plate 14, to serve as propellant fill passageways. An annular seal 34 is provided on the periphery of the plate 14, and a pair of annular seals 36 are provided on the periphery of the body 16 straddling the fill passageways.

The plugs 24 may be embodied as relief valves, individual plugs, a burst diaphragm fixed to the forward face of the injector plate, or simply portions of the bore material not fully drilled through, all of which will shear or open at the desired pressure level.

The penetrator and sabot assembly may be preloaded with liquid propellant through the fill passageways, which are then plugged, before being placed in the gun. Alternatively, the assembly may be placed in the firing bore 40 of the gun and then loaded with propellant. The actual firing process is the same for each scheme, and loading within the gun will be discussed with respect to FIGS. 2A through 2C.

Figure 2A:
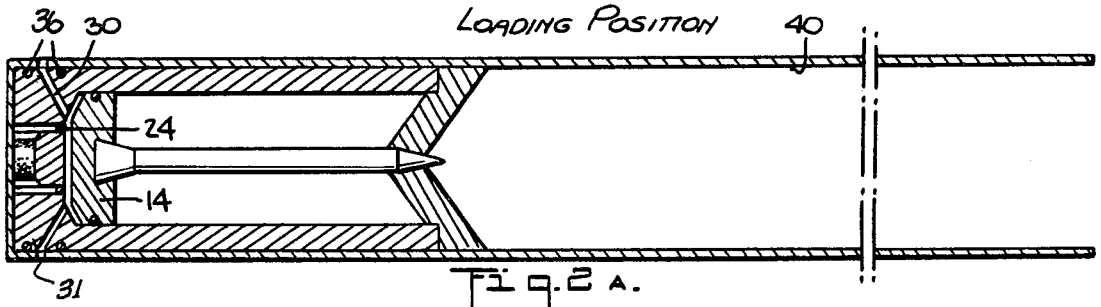
FIG. 2A through E respectively illustrate, within the gun bore, the (A) before charging with liquid propellant configuration, (B) after charging with liquid propellant and ready for initiation of the primer configuration, (C) shortly after initiation and commencement of injection of liquid propellant into the combustion chamber configuration, (D) midbore configuration, and (E) bore exiting and sabot stripping configuration, in the sequence of operations of the round of FIG. 1.

As shown in FIG. 2A, the penetrator and sabot assembly, still without its propellant charge, has been placed into the breech of a gun barrel and the breech has been closed. The fill passageways 30 are aligned with suitable fill ports 31 in the breech wall of the gun, such as are shown in U.S. Pat. No. 3,763,739, supra, which must incorporate high pressure fill valves or check valves which can withstand firing pressure. These passageways serve as means for providing liquid propellant to the round of ammunition in the firing bore.

Figure 2B:
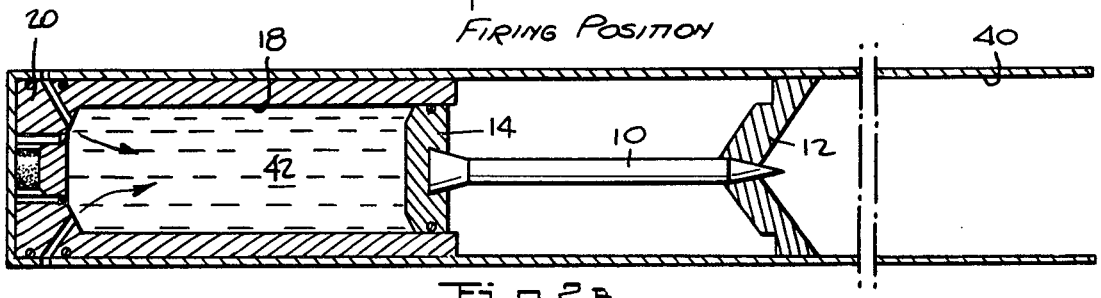

As shown in FIG. 2B, propellant is pumped into the interface between the injector plate 20 and the pusher plate 14, progressively pushing the pusher plate forward within the bore 18 to create an injection volume 42 which receives a complete charge. Stops can be provided to halt the forward advance of the nose stabilizer, or preferably, the charge can be metered. The round is shown fully charged and ready for firing.

Figure 2C:
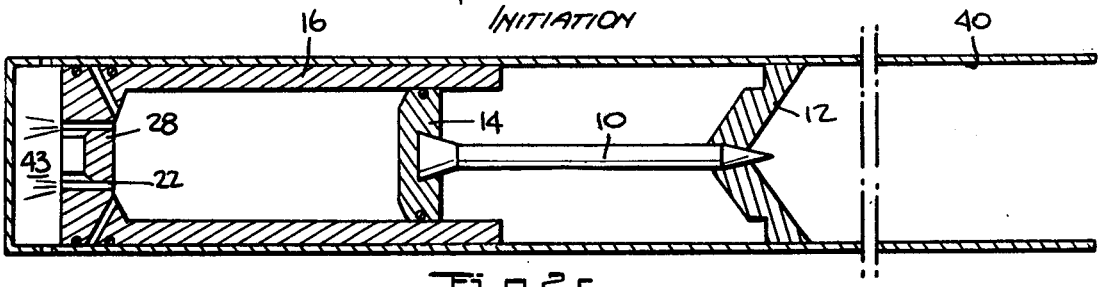

As shown in FIG. 2C, firing is initiated by setting off the primer, which rapidly generates a small volume of high pressure, hot gas in the space 43 aft of the injector plate which serves as the combustion chamber. This high pressure aft of the loaded round produces an immediate acceleration of the complete round. The overall force producing the acceleration, which force is equal to the chamber pressure times the chamber cross-sectional area, is exerted against the aft face of the injector plate. The penetrator and sabot assembly has a relatively high weight relative to the weight of the body 16 with a correspondingly relatively high inertia. A portion of the accelerating force is absorbed in accelerating the body 16 per se, but the remainder of the accelerating force is transmitted by the forward surface of the injector plate against the charge of liquid propellant. The resultant pressure developed in the liquid is the transmitted force divided by the liquid or injection volume cross-sectional area. When the ratio of the areas of the aft face of injector plate and the injection volume, and the body weight and the total round weights are properly predetermined, a liquid pressure will be generated which is higher than the chamber pressure as follows:

$$\frac{P_L}{P_C} = \frac{A_C}{A_L}\left(1 - \frac{W_B}{W_{TOT}}\right)$$

where $P_L$ is liquid pressure,
$P_C$ is chamber pressure,
$A_C$ is chamber area,
$A_L$ is liquid area,
$W_B$ is body weight, and
$W_{TOT}$ is the sum of the body, the liquid and the penetrator and sabot assembly weights.

The difference between the two pressures $P_L$ and $P_C$ is the driving force which can be utilized for regenerative injection.

Figure 2D:
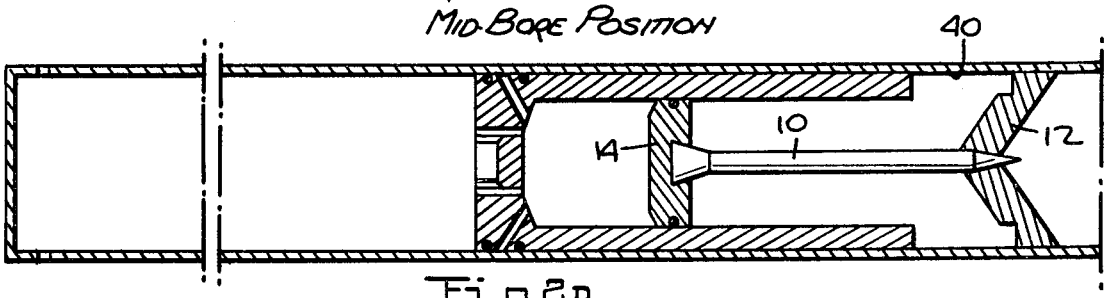

The plugs 24 are designed to open at a predetermined difference in pressure between the interior volume and the combustion chamber. These plugs serve as a pressure sensitive obturating means. As shown in FIG. 2C, when this difference is reached, the plugs will open and propellant will flow into the chamber. The injection passageways 22 serve to atomize or break up the propellant streams through techniques similar to those used in rocket injector design. As the propellant streams initially encounter the hot primer gases they ignite, generating more hot gas. Incoming propellant continues to ignite and the process becomes self-sustaining, and generates increasing chamber pressure, which accelerates the process. The process continues until the propellant is expended. Meanwhile, the whole round is being accelerated along the bore by what is in effect, a traveling charge. FIG. 2D shows the round at mid-bore length with the propellant partially expended.

Figure 2E:
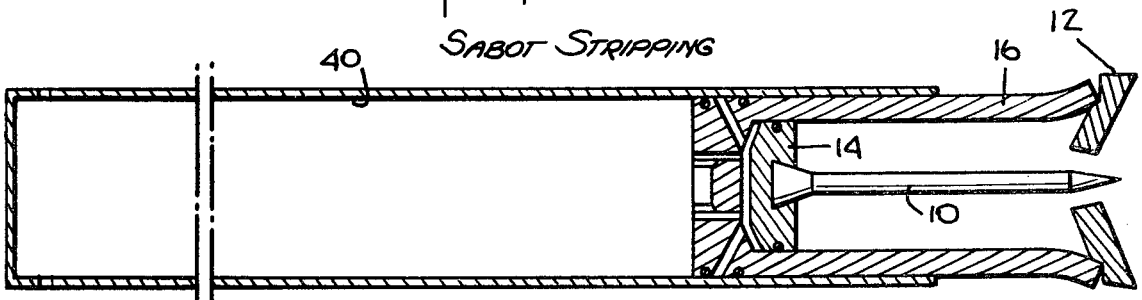

As the round leaves the muzzle, the sabot fore and aft supports are stripped from the penetrator which continues on its course. FIG. 2E shows the nose stabilizer 12 acting under wind forces to open the body 16 and free the penetrator.

The entire body 16 is here shown as engaging the rifling of the bore 40 to provide spin to the entire round if a spin stabilized projectile is used. Alternatively a lesser annular portion of the body may engage the rifling.

SECOND EMBODIMENT

Frictional forces are developed between the body 16 and the interior wall of the bore 40 as the round is launched, which are a function of the materials of the body 16 and the bore 40 of the gun barrel. An alternative embodiment which minimizes such frictional forces is shown in FIG. 3.

The penetrator 50 is here shown as a rod which is stabilized by a plurality of fins 52. The sabot is a three piece assembly comprising an annular nose stabilizer 54 fixed to the forward end of the penetrator, a circular pusher-plate 56 fixed to the aft end and an injection plate 58 having a plurality of forwardly, longitudinally extending, integral rods 60. The pusher plate 56 has a like plurality of longitudinal bores 62 with respective annular seals 64 each passing a respective one of the rods 60. The injector plate 58 also has a plurality of longitudinal bores 66 therethrough each obstructed by a respective plug 68, and an aft recess 70 receiving a primary propellant charge 72, all similar to the embodiment of FIG. 1. These plugs serve as a pressure sensitive obturating means. An annular seal 74 is provided in the periphery of the injector plate, and an annular seal 76 is provided in the periphery of the pusher plate. This penetrator and sabot assembly is disposed in the gun for filling with propellant with the fill ports in the breech wall of the gun aligned with the interface between the injection plate and the pusher plate.

The use of the rods 60 upon which the pusher plate can slide permits the omission of the body structure, so that only the peripheries of the pusher plate, the injector plate and the stabilizer need contact the wall of the barrel bore 40. The liquid propellant is contained between the pusher plate, the injector plate and the wall of the barrel bore. The necessary differential in areas is provided by the total cross-sectional areas of the rods 60. The rods provide an added advantage in the sabot stripping phase of the launching cycle as they are relatively weaker and therefore easier to deflect radially outwardly than the equivalent cylindrical body 16.

Both of the embodiments described above provide the following advantages:

1. Controlled injection is achieved through regenerative pumping action;
2. The inertia of the projectile itself is the source of the pumping force;
3. The injection mechanism is incorporated into the penetrator and sabot assembly, with very little effect on the gun design;
4. A traveling charge effect is achieved;
5. The injection system and high pressure seals are used only once for each shot and are then discarded.
6. The sabot and projectile assemblies may be stored and transported as essentially inert, considering the primer to be relatively insignificant. The assemblies do not become active until the introduction of the propellant. This can be delayed until after chambering and locking in the gun.

The specification so far has dealt with idealized projectile and sabot assemblies and their launching techniques. Cartridges embodying such assemblies may be provided in at least several different configurations.

THIRD EMBODIMENT

FIG. 4 shows the simplest pre-filled cartridge case embodiment. The projectile and sabot assembly are crimped into a cartridge case 100. The assembly comprises a forward annulus 102 which serves as a pusher plate and has a central bore 104 receiving a spin stabilized projectile 106 and a plurality of bores 108 disposed in an annular row, each receiving a respective one of a like plurality of rods 110 which are respectively fixed to an injector plate 112. The injector plate has an annular seal 114 fixed to its periphery and a plurality on longitudinal injection passageways 116 which are closed by a diaphragm 118 fixed to the forward face of the plate. The liquid propellant charge 120 is contained between the annulus 102, the plate 112 and the inner wall 122 of the case 100. The bore of the case includes an external primer 124 in communication with an internal booster tube 126 disposed in the combustion chamber 128 which is defined by the base of the case, the injector plate and the interior wall of the case. Upon ignition the injector plate and its rods move forwardly relative to the annulus, rupturing the diaphragm and injecting propellant into the combustion chamber. This diaphragm serves as a pressure sensitive obturating means. The inner wall 122 of the case is cylindrical and coplanar with the inner wall 40 of the bore of the gun barrel, so that the forward annulus and the injector plate smoothly leave the case and ride along the gun bore. The forward annulus may be made up of segments to provide ready rupture and release of the projectile when the assembly leaves the gun bore.

The injector plate 112 may be made of arched cross-section for a greater strength to weight ratio.

The rods 110 may be replaced with hollow tubes **110*a*, as shown in FIG. 4*a*, which are closed at their forward ends and open at their aft ends so that the interior volume of each tube communicates with and is at the same pressure as the combustion chamber 128. This permits the use of a thin wall tube whose wall thickness become progressively thinner from front to rear; since as the length of the tube exposed forwardly of the annulus 102** into the atmosphere increases, the combustion chamber pressure decreases.

FOURTH EMBODIMENT

In the embodiments discussed above, all of the injection of the propellant into the combustion chamber takes place through the passageways of the injector plate. An enlarged "Taylor cavity" will be formed by providing a tubular cylinder of propellant liquid in the combustion chamber as said chamber is being enlarged by the forward movement of the injector plate. The "Taylor cavity" provides a liquid-gas interface for combustion. This is accomplished by providing a variable internal diameter in the case which increases towards the mouth of the case. As shown in FIG. 5, the bore 150 of the case may be tapered, or as shown in FIG. 6, the bore 152 of the case may be stepped to provide a variable, increasing, orifice for the liquid propellant around the periphery of the injector plate.

FIFTH EMBODIMENT

The injector plate should be prevented from moving aft under impulse loads exerted by the liquid propellant under conditions of vigorous handling or in the event a cartridge is dropped on its base. This can be accomplished by providing stops on the displacement rods aft of their engagement with the injector plate; a step can be provided in the interior wall of the case aft of the injector plate; or the injector plate may be fastened to the interior wall of the case by a weak joint which will rupture under the firing forces. To further minimize the effects of handling loads the stops may be made resilient. As shown in FIG. 7, the interior wall 154 may be provided with a step 156 to abut the outer margin of the injector plate 158. A helical spring 160 may be captured between an additional step 162 and the injector plate to resiliently fix the inputs plate and to permit it to move aft slightly before abuting the positive shoulder 156.

SIXTH EMBODIMENT

In the embodiment shown in FIG. 8, a prefilled case is provided which has an interior annular wall 200 extending from the base 202 which together with the injector plate 204 and its peripheral seal 205 defines an initial combustion chamber. An external primer 206 communicates with an internal booster 208 disposed in the initial combustion chamber. A plurality of rigid, spaced apart, partitions 210 extend inwardly from the interior wall 212 of case which is tapered progressively inwardly from the base to the neck 214 to provide a series of compartments 216 of decreasing volume, each opening into a central bore 217. As described with respect to FIG. 4, the injector plate is fixed to rods 218 which are journaled through respective bores 219 in an annulus 220 which retains the projectile 222. The bore 223 of the neck is coplanar with the gun bore 40. Liquid propellant is stored forward of the injection plate in the compartments 216 and in the central bore. The propellant in the central bore is injected into the combustion chamber by the injection plate as discussed with respect to FIG. 4. The propellant in each open compartment 216 tends to remain in place and to ignite as its compartment is exposed to the initial combustion chamber as the injection plate moves forward, also providing a "Taylor Cavity" effect.

SEVENTH EMBODIMENT

FIGS. 9 and 10 show a dry loaded cased cartridge embodiment, similar to the case of FIG. 4. The cartridge is provided with a case 250 having a primer 252 communicating with a booster charge 254, and a projectile and sabot assembly. The sabot includes an injector plate 256 having a peripheral seal 258 and a plurality of longitudinally extending rods 260 fixed thereto and respectively journaled through bores 261 in an annulus 262 which has a peripheral seal 264 and an axial bore 266 receiving a projectile 268. A stabilizing ring 270 is retained against non-firing loads aft of the mouth of the case as by cementing or crimping and has a like plurality of bores 272 journaling said rods 260 and an axial bore 274 adapted to pass the projectile. A plurality of radial bores 276 are disposed through the case in an annular row to serve as propellant filling passageways. In the stored configuration, as shown in FIG. 9, the annulus 262 is nested aft, close to the injector plate, without any liquid propellant, and the seals 258 and 264 straddling the row of bores 276. After the case has been loaded into the gun and the gun breech has been locked, the liquid propellant charge is pumped through aligned ports in wall of the breech of the gun as described with respect to FIG. 2B. The injector plate is prevented from aftward movement by suitable means, such as the stops described with respect to FIG. 7. As the liquid propellant charge is pumped into the interface between the injector plate and the annulus, it forces the annulus forward until it is stopped by the stabilizing ring, which provides an automatic metering device for the filling operation.

Both pre-loaded and dry-loaded cased cartridges share the following advantages:

1. Sealing of the breech is provided by the case.
2. The priming system is conveniently provided for each round.
3. A misfired round can be completely extracted by extracting the case.

The dry-loaded cartridge has the additional following advantages for shipping and handling:

1. The projectile is telescoped within the case for shipping and for loading into the gun. This minimizes the length of the parts to be handled.
2. The cartridge is relatively safe. In the absence of propellant, the primer and booster are the only combustible components present.
3. The propellant is loaded separately through control valves and piping. This can be controlled remotely if necessary.
4. The breech is closed before the propellant is charged into the cartridge, providing additional safety.

EIGHTH EMBODIMENT

FIGS. 11 and 12 show a dry-loaded uncased cartridge, which is loaded, locked, filled and fired in a manner similar to the cased cartridge of FIGS. 9 and 10. The sabot and projectile assembly comprises an injector plate 300 having a peripheral seal 302 and a plurality of longitudinally extending rods 304 fixed thereto and respectively journaled through bores 305 in an annulus 306 which has a peripheral seal 307 and an axial bore 308 receiving a projectile 310. A stabilizing ring 312 has a like plurality of bores 314 journaling said rods 304 and an axial bore 316 adapted to pass the projectile. As shown in FIG. 13, a primer and booster assembly comprises a sleeve 318 which cemented to the aft face of the injector plate 300. The sleeve is molded of solid propellant, of sufficient strength to provide a small combustion chamber 320 initially, but which will ultimately burn. A combustible primer 322 is fixed in a cup 324 in the exterior of the base of the sleeve and which communicates by a passageway 326 with the combustion chamber 320. The forward end of the sleeve is closed with a plug 328 which may be cemented. Radially extending flame passageways 330 are provided through the walls of the sleeve. These passageways are initially closed, as by plugs, being only partially formed through, or covered by a diaphragm. Loose powder is disposed in the combustion chamber.

The length of the primer and booster assembly is made equal to the length of the combustion chamber of the gun. When the cartridge is chambered and the breech is locked, the primer 322 is adjacent the face 332 of the breech block, and may be ignited by a conventional percussion firing pin 334, or electrical firing means. The primer ignites the loose powder immediately, generating hot gases which rupture the flame passageway closures and pass into the combustion chamber. The molded combustible sleeve burns more slowly than the loose powder, but eventually all is consumed. The hot gas initiates the regenerative liquid propellant injection process as described previously.

The dry-loaded caseless cartridges have the following advantages:

1. The system is completely combustible. The gun chamber is completely empty after each shot.
2. The primary system is an integral part of the cartridge as supplied to the gun.
3. The primary system may be fabricated using conventional caseless ammunition technology.

NINTH EMBODIMENT

FIG. 14 shows a recoiless gun embodiment of a caseless cartridge similar to that shown at FIG. 12. The sabot and projectile assembly comprises an injector plate 400 having a peripheral seal 402 and a plurality of longitudinally extending rods 404 fixed thereto and respectively journaled through bores 405 in an annulus 406 which has a peripheral seal 408 and an axial bore 410 receiving a projectile 412. A stabilizing ring 414 has a like plurality of bores 416 journaling said rods 404 and an axial bore 418 adapted to pass the projectile. A priming system comprising a sleeve 420 which may be molded of solid propellant is cemented to the aft face of the injector plate 400. The sleeve has radially extending flame passageways 422 which are initially closed and contains loose powder which may be ignited by an electrical firing system 424. A frangible diaphragm 426 is cemented to the aft end of the sleeve. The initial combustion chamber is provided within the sleeve, and the subsequent combustion chamber is defined between the injection plate and the diaphragm. The diaphragm is adapted to burst at a pressure which is high enough to insure that initiating combustion has been achieved.

The gun 427 includes suitable ports 428 to pass liquid propellant to the interface between the injection plate 400 and the annulus 406. The gun also includes a converging/diverging nozzle 430 in lieu of the conventional closed breech. This nozzle may be of the type shown, for example, in U.S. Pat. Nos. 2,444,949, 2,696,760, 2,790,353 and 3,610,093. The nozzle provides an expansion chamber and a venturi orifice therein to allow a sufficient amount of the combustion gases to expand and escape rearwardly, thereby stabilizing the gun against recoil. The nozzle may be made separable from the breech to permit loading of the cartridge. FIG. 14 shows the annulus 406 midway in its forward advance during the loading with liquid propellant.

TENTH EMBODIMENT

FIG. 15 shows a recoiless gun embodiment of a cased, preloaded cartridge. The cartridge includes a case 500 having a side 502, a shoulder 504, a neck 506 and a base plate 508 threaded into the side 502. A projectile 510 is crimped into the neck, and is received in the firing bore 512 of the gun. The base plate 508 has central bore 514 with an annular seal 516 to pass the neck 518 of a tubular injector and nozzle assembly. This assembly includes an annular injection plate 520 having an annular seal 522 integral with the forward end of the neck and a converging/diverging nozzle 523 integral with the aft end of the neck. A frangible diaphragm 524 is cemented over the forward end of the tube and an annular priming system 526 is cemented onto the diaphragm. The priming system is similar to a torus of square cross-section, having flame passageways, loose powder, and an electrical firing system whose leads may be brought through the diaphragm and out the bore of the neck and the nozzle or through the sidewall of the case. Liquid propellant is stored in the chamber defined by the base plate 508, the injection plate 520, the side 502, and the neck 518.

This embodiment does not provide a traveling charge. Ignition of the primary system ruptures the diaphragm and moves the injector and nozzle assembly aft, which in turn provides regenerative pumping forwardly of the liquid propellant through the passageways of the injector plate.

ELEVENTH EMBODIMENT

FIG. 16 shows a recoilless gun embodiment of a cased cartridge employing a reaction or compensating mass of the type shown in U.S. Pat. No. 1,108,716. This embodiment does not provide a traveling charge. In its simplest form, the gun includes a firing bore 600 open at both ends. A projectile 602 and an injector and reaction mass assembly are secured in a tubular cartridge case 603 which is disposed in the bore 600. The assembly comprises a solid reaction mass 604 having a peripheral seal 606 and a central bore with an annular seal 607, in which is journaled a rod 608 to whose forward end is fixed an injection plate 610 having a peripheral seal 612. A priming system 614 is fixed to the forward face of the injection plate. The priming system may comprise a sleeve molded of combustible material with flame passageways, filled with loose powder, and having an electrical firing means which may be brought out through the rod 608. Firing is initiated by hot gases generated by the priming system in the combustion chamber defined between the projectile and the ignition plate. The liquid propellant is stored in the chamber defined between the injection plate and the reaction mass, and serves as part of the total reaction mass, so that the solid mass actually ejected out the breech of the gun is less than required by fixed, solid propellants. In a caseless embodiment, not shown, the case is omitted and the liquid propellant is injected as discussed with respect to FIG. 2B.

It is contemplated that the inventive concepts hereinabove described may be variously otherwise embodied and combined without departing from the inventive principles included and intended to be covered by the appended claims, except insofar as limited by the prior art.

What is claimed is:

1. A weapon system comprising:

a gun; and a round of ammunition;

said gun having a firing bore closed by a breech face;

said round of ammunition disposed in said firing bore adjacent said breech face;

said round of ammunition including:

a relatively high mass projectile means having an aft face; and a relatively low mass piston, longitudinally spaced from said projectile, having an aft face of relatively large cross-sectional area spaced from said breech face and a forward face of relatively small cross-sectional area, a passageway therethrough, communicating between said aft and forward faces of said piston, and a pressure sensitive obturating means, obturating said passageway and adapted to open said passageway upon a predetermined pressure being provided on said forward face; and said firing bore has an extension aft of said breech face formed as a converging/diverging nozzle, and said breech face is provided by a burstable diaphragm disposed in said firing bore aft of said round and forward of said nozzle.

* * * * *

UNITED STATES PATENT OFFICE

CERTIFICATE OF CORRECTION

Patent No. 4,132,149 Dated January 2, 1979

Inventor(s) Eugene Ashley

It is certified that error appears in the above-identified patent and that said Letters Patent are hereby corrected as shown below:

Column 10, line 10 change "primary" to --priming--.

Signed and Sealed this

*First* Day of *May 1979*

[SEAL]

*Attest:*

RUTH C. MASON
*Attesting Officer*

DONALD W. BANNER
*Commissioner of Patents and Trademarks*